US005562869A

United States Patent [19]

Drahos et al.

[11] Patent Number: 5,562,869

[45] Date of Patent: Oct. 8, 1996

[54] CARBURETOR FUEL ATOMIZING DEVICE

[75] Inventors: Lloyd J. Drahos; Guy W. Hostetter, both of Rochester, Minn.

[73] Assignee: Unique Innovations, Inc., Rochester, Minn.

[21] Appl. No.: 287,134

[22] Filed: Aug. 8, 1994

[51] Int. Cl.[6] ..... F02M 19/03

[52] U.S. Cl. ..... 261/71; 261/78.1; 261/DIG. 1; 261/DIG. 39

[58] Field of Search ..... 261/78.1, DIG. 1, 261/66, 71, DIG. 39, 78.2

[56] References Cited

U.S. PATENT DOCUMENTS

| | | | |
|---|---|---|---|
| 2,560,220 | 7/1951 | Graziano | 219/38 |
| 2,714,503 | 8/1955 | Heisler | 261/78 |
| 2,899,185 | 8/1959 | Rector | 261/72 |
| 3,012,400 | 12/1961 | Corson, Jr. | 60/35.6 |
| 3,437,467 | 4/1969 | Jacobus | 48/180 |
| 3,467,072 | 9/1969 | Toesca | 123/141 |
| 3,873,650 | 3/1975 | Lamkin | 261/78 |
| 3,883,621 | 5/1975 | Hammerschmied | 261/78.1 |
| 3,955,545 | 5/1976 | Priegel | 123/119 |
| 4,094,934 | 6/1978 | Tuckey et al. | 261/64 |
| 4,105,003 | 8/1978 | Funk | 261/78.1 |
| 4,133,849 | 1/1979 | Hecht | 261/78 |
| 4,139,582 | 2/1979 | Collins | 261/51 |
| 4,171,332 | 10/1979 | Gohnert | 261/78 |
| 4,259,021 | 3/1981 | Goudy, Jr. | 366/118 |
| 4,263,233 | 4/1981 | Fenn | 261/78.1 |
| 4,358,414 | 11/1982 | Webster | 261/78.1 |
| 4,473,057 | 9/1984 | Callins | 261/78.1 |
| 5,043,105 | 8/1991 | Drahos | 261/78.1 |
| 5,053,170 | 10/1991 | Drahos | 261/78.1 |

FOREIGN PATENT DOCUMENTS

| | | | |
|---|---|---|---|
| 316475 | 4/1903 | France . | |
| 503520 | 6/1920 | France | 261/78.1 |
| 1008178 | 5/1952 | France | 261/78.1 |
| 56-151249 | 11/1981 | Japan | 261/78.1 |
| 0228322 | 10/1985 | U.S.S.R. | 261/78.1 |
| 1330200 | 9/1973 | United Kingdom | 261/78.1 |
| 2032521 | 5/1980 | United Kingdom | 261/78.1 |
| 81/02611 | 9/1981 | WIPO | 261/78.1 |

*Primary Examiner*—Khanh P. Nguyen

*Attorney, Agent, or Firm*—Nawrocki, Rooney & Sivertson, P.A.

[57] ABSTRACT

Apparatus for atomizing fuel in a carburetor having a fuel inlet. The apparatus includes a mechanism for improved atomization of fuel leaving the fuel inlet. A mechanism is included for adjusting the atomization of fuel by adjusting the atomizing fuel mechanism relative to the fuel inlet. The atomizing fuel mechanism is supported within the carburetor. The support may extend through the carburetor housing or be formed integral the carburetor housing. Alternatively, a support may be carried by the fuel inlet.

16 Claims, 1 Drawing Sheet

CARBURETOR FUEL ATOMIZING DEVICE

FIELD OF THE INVENTION

The present invention relates to carburetors. In particular, the present invention relates to an apparatus for atomizing fuel in a carburetor, which improves fuel efficiency and engine performance and results in cleaner exhaust emissions.

BACKGROUND OF THE INVENTION

A carburetor functions to vaporize a mixture of fuel and air needed for operation of an engine. The carburetor includes a main chamber having a fuel inlet nozzle and a throttle system. The fuel inlet nozzle connects the carburetor chamber with the fuel system. The fuel inlet nozzle is located upstream of the throttle system.

In operation, a pulsating vacuum is created within the carburetor chamber due to downstream engine piston strokes. The pulsating vacuum draws fuel droplets through the fuel inlet nozzle and into the carburetor main chamber. In the carburetor main chamber, the fuel droplets mix with air, atomizing into a vaporized flammable gas. The vaporized mixture then passes downstream past the throttle system to the combustion chambers of the engine cylinders.

The degree of fuel mixture within the carburetor combustion chamber has a direct effect upon engine performance. Improper fuel mixing can cause the fuel mixtures to be too lean or rich, resulting in poor engine performance. Improved atomization or vaporization of fuel entering the carburetor, results in more efficient engine operation.

Fuel atomization and vaporization within the carburetor also effects the quality of exhaust emissions. Due to increasing exhaust emission regulations and greater environmental awareness, it has become increasingly important to cut down on the amount of harmful pollutants released into the environment through engine exhaust systems. By increasing the amount of fuel atomization and vaporization within a carburetor, harmful pollutants, such as carbon monoxide and hydrocarbons which are released through the exhaust system into the environment are greatly reduced.

Exhaust emission standards have become increasingly stricter for general automobile, commercial, and industrial exhaust systems. Historically, improved fuel atomization for cleaner exhaust emissions for small engines was not a concern. More recently, present and future regulations are being proposed and enforced to extend exhaust emission standards to small engines, such as two cycle engines. Small engines are used in snowmobiles, motorcycles, mopeds, chain saws, line trimmers, lawn mowers and many other commonly used machines.

One such device is suggested in U.S. Pat. No. 5,043,105 to Drahos, a common invention to the inventor of the present invention, which suggests a fuel atomizing device for carburetors. The device includes applications for carburetors having a main discharge nozzle located within at least one venturi. The device includes a body which extends downward to slide over the main fuel discharge nozzle. Fuel enters the venturi at an angle through the fuel inlet nozzle which atomizes on the bottom of a disk-shaped member. The fuel vapor is then drawn through the venturi down to the throttle system.

SUMMARY OF THE INVENTION

The present invention includes an apparatus for atomizing fuel in a carburetor. The apparatus is easily adaptable for use with small engines, both existing and new, for improving atomization of fuel within the carburetor resulting in improved engine performance and cleaner exhaust emissions.

In one embodiment, the present invention includes an apparatus for atomizing fuel in a carburetor having a fuel inlet. Means are included for atomizing fuel leaving the fuel inlet. Additionally, means are included for supporting the atomizing fuel means within the carburetor, and means are included for adjusting the atomizing fuel means relative to the fuel inlet, having a common longitudinal axis with respect to the fuel inlet.

The atomizing fuel means may include a generally disk-shaped member. The generally disk-shaped member may include a flange for providing additional surface area and an edge for further fuel atomization. The atomizing fuel means is located along a common longitudinal axis with respect to the fuel inlet which is generally perpendicular to the surface of the atomizing fuel means.

The generally disk-shaped member may take on many shapes and have many different surface constructions for providing different degrees of fuel atomization within the scope of the present invention. The disk-shaped member may have a smooth surface, or alternatively, it may be notched, cone shaped, or etched. In a preferred embodiment, the disk-shaped member has a surface includes shallow grooves in a diamond shaped pattern.

The supporting means may include a generally tubular member which is molded integral the carburetor housing. Alternatively, the supporting means may extend through the carburetor housing, especially for retrofit applications. In yet another embodiment, the supporting means may be carried by the fuel inlet nozzle.

Adjusting means adjust the atomizing fuel means relative to the fuel inlet. In a preferred embodiment, a generally disk-shaped atomizing fuel means is located at the end of the fuel inlet. The adjusting means may be adjusted for providing different degrees of fuel atomization. The adjusting means may extend through the carburetor housing and include a handle which allows adjustment from a location exterior the carburetor housing.

In yet another embodiment, the present invention includes an apparatus for atomizing fuel in a small engine carburetor. The apparatus includes means for atomizing fuel leaving the fuel inlet, which may be generally disk-shaped having an atomizing surface. In a preferred embodiment, the atomizing surface is located next to the end of the fuel inlet. Means are included for supporting the atomizing fuel means within the carburetor, which may extend from the carburetor side wall, may be formed integral the carburetor, or may be carried by the fuel inlet. Additionally, the apparatus may include means for adjusting the atomizing fuel means relative to the fuel inlet.

The present invention improves atomizing of fuel in a carburetor, and is easily adaptable for use with small engine carburetors. The novel apparatus of the present invention provides engine operators, including small engine owners, with improved fuel atomization for greater engine performance and cleaner exhaust emissions.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

The present invention is an apparatus for atomizing fuel in a carburetor. The present invention improves atomizing of fuel in the carburetor and it is easily adaptable for use with new and existing small engine carburetors. The novel apparatus of the present invention provides engine operators, including small engine owners, with improved fuel atomization for greater engine performance and cleaner exhaust emissions.

Figure 1:
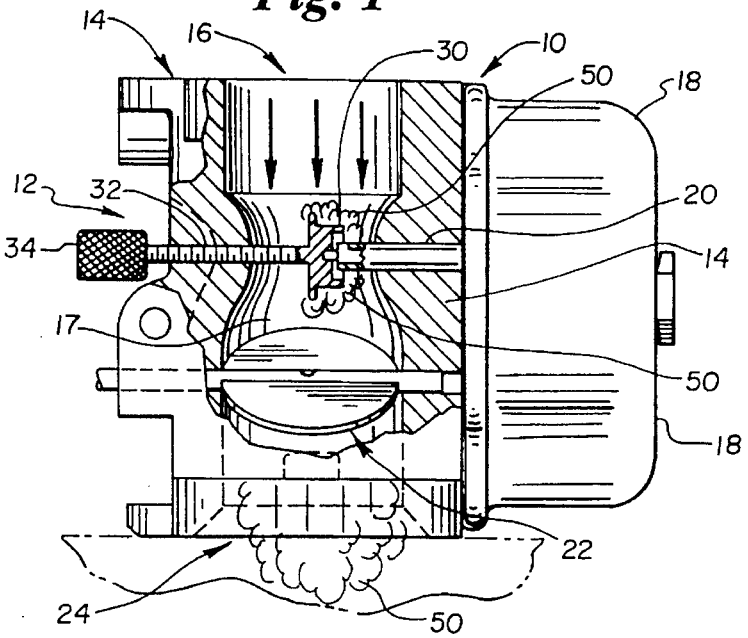
FIG. 1 is a side elevational view of a carburetor with parts cutaway to show the apparatus for atomizing fuel of the present invention.

FIG. 1 shows a carburetor system generally at 10 having a fuel atomizer 12 of the present invention. The carburetor system 10 includes a housing 14, air intake 16, fuel well 18, fuel inlet nozzle 20, throttle system 22, and outlet 24.

Air enters the carburetor housing 14 at air intake 16 where it mixes with fuel within carburetor chamber 17. Fuel enters carburetor chamber 17 through fuel inlet nozzle 20 which extends through housing 14 to fuel well 18. In turn, the fuel well 18 is connected to the engine fuel system (not shown). The intake air mixes with fuel in carburetor chamber 17. Throttle system 22, located downstream of fuel inlet nozzle 20, regulates the amount of fuel mixture which passes through carburetor system 10.

In operation, air is drawn into carburetor housing 14 at air intake 16 (indicated by air vectors 17) due to the pulsating vacuum which is created within the carburetor chamber 17 from downstream engine piston strokes. Simultaneously, the pulsating vacuum draws fuel droplets through the fuel inlet nozzle 20 and into the carburetor chamber 17. Within carburetor chamber 17, the fuel droplets mix with the air, resulting in a vaporized mixture of flammable gas and fuel. The vaporized mixture then passes downstream past the throttle system 22, into the intake manifold (not shown), and on to the combustion chambers of the engine cylinders.

Fuel atomizer 12 of the present invention, shown in FIG. 1, is located within carburetor system 10. Fuel atomizer 12 includes atomizing head 30, body 32, and handle 34. Atomizing head 30 is positioned next to fuel inlet nozzle 20. Body 32 extends through carburetor housing 14, through carburetor chamber 17, and connects to atomizing head 30. Handle 34 is connected to the end of body 32 exterior of carburetor system 10.

Handle 34 allows atomizing head 30 to be adjusted from a point exterior of carburetor system 10. In the embodiment shown, body 32 is threadably received by carburetor system 10 housing 14. By turning handle 34, atomizing head 30 is moved relative to fuel inlet nozzle 20, providing varied degrees of fuel atomization.

Fuel atomizer 12 greatly improves fuel atomization within carburetor chamber 17, resulting in improved engine performance and cleaner exhaust emissions.

Figure 2:
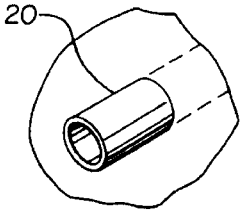
FIG. 2 is an enlarged fragmentary perspective view of the fuel inlet tube shown in FIG. 1.

FIG. 1 shows atomizing head 30 positioned next to fuel inlet nozzle 20. FIG. 2 is an enlarged fragmentary perspective view of fuel inlet nozzle 20. The end of fuel inlet nozzle 20 may be smooth and well rounded, or it may be notched or grooved.

Figure 3:
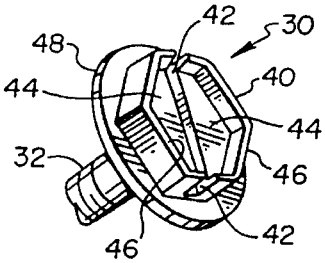
FIG. 3 is an enlarged fragmentary perspective view of one embodiment of the present invention.

FIG. 3 is an enlarged fragmentary perspective view of the fuel atomizer 12 of the present invention. In this embodiment, atomizing head 30 includes a disk 40, having a groove 42, surface 44, side walls 46, and flange 48. As previously indicated, a pulsating vacuum is created within carburetor chamber 17 due to the downstream engine piston strokes. The pulsating vacuum draws fuel droplets through fuel inlet nozzle 20 in a pulsating manner. These fuel droplets come in contact with atomizing head 30 for mixing with carburetor intake air.

Fuel atomizer 12 is located along a common longitudinal axis with respect to fuel inlet nozzle 20, which is generally perpendicular to the surface 44. Atomizing head 30 may be centered with respect to fuel inlet nozzle 20, or alternatively, atomizing head 30 may be located off center with respect to fuel inlet nozzle 20. In one preferred embodiment, fuel atomizer 12 is centered with respect to fuel inlet nozzle 20 and in light contact with the end of fuel inlet nozzle 20.

As fuel contacts with atomizing head 30 at groove 42 and surface 44, a violent reaction occurs. The fuel droplets spread out along groove 42 and surface 44, atomizing with air at the ends of groove 42 and side walls 46. Additionally, fuel comes in further contact with the edges of disk 40 for increased fuel atomization. The fuel atomization is shown in FIG. 1 indicated by vapor clouds 50.

The improved fuel atomization, indicated by vapor clouds 50, are then drawn onto downstream combustion chambers of the engine cylinders. The improved atomization results in more efficient combustion within the engine cylinders, and subsequently more efficient operation of the engine.

Engine exhaust emissions release harmful pollutants, such as carbon monoxide and hydrocarbons, into the environment. By using the fuel atomizer of the present invention, improved engine operation results in vastly cleaner exhaust emissions and less harmful amounts of pollutants being released into the environment. More importantly, the use of fuel atomizer 12 within the carburetor system allows many engine owners to meet the strict regulations being imposed upon engine exhaust emissions.

The fuel atomizer 12 shown in FIG. 1 is easily adjustable, providing the user with the ability to adjust fuel atomizer 12 for different degrees of fuel atomization. Although handle 34 is shown as a knurled knob, it is recognized that handle 34 may take on many shapes and sizes, such as a screw head, and still be within the scope of the present invention. In one preferred embodiment, fuel atomizer 12 is adjusted to be in light contact with fuel inlet nozzle 20.

Alternatively, it is recognized that fuel atomizer 12 may be integrally molded with carburetor system 10 housing 14. In this embodiment, atomizing head 30 would be located a predetermined distance from fuel inlet nozzle 20. In one preferred embodiment, atomizing head 30 would be in light contact with fuel inlet nozzle 20.

Fuel atomizer 12 is formed of material suitable for carburetor environment. Fuel atomizer 12 may be formed of metal, nonmetal, or a combination of metals and nonmetals.

Fuel atomizer 12 is easily adaptable to new and existing small engine carburetors. For example, by simply drilling a hole in carburetor housing 14, an existing carburetor system 10 may be retrofit with the novel fuel atomizer 12 of the present invention. The ease of adaptability to new and existing carburetor systems becomes even more important with increases in exhaust emissions regulations.

Figure 5:
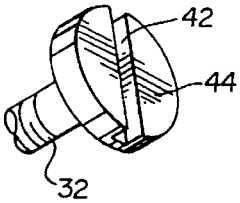
FIG. 5 is an enlarged fragmentary perspective view of another alternative form of the present invention.
Figure 4:
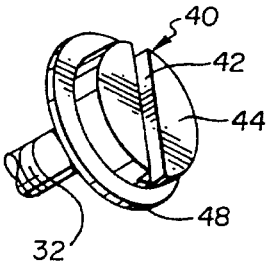
FIG. 4 is an enlarged fragmentary perspective view of an alternative form of the present invention.
Figure 7:
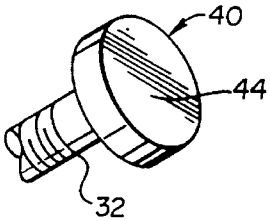
FIG. 7 is an enlarged fragmentary perspective view of another alternative embodiment of the present invention.
Figure 6:
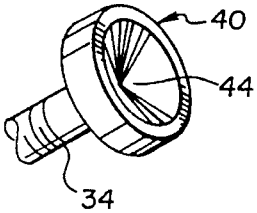
FIG. 6 is an enlarged fragmentary perspective view of another alternative embodiment of the present invention.
Figure 8:
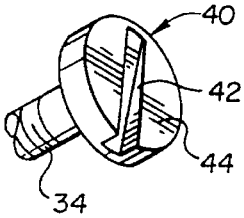
FIG. 8 is an enlarged fragmentary perspective view of another alternative embodiment of the present invention.
Figure 9:
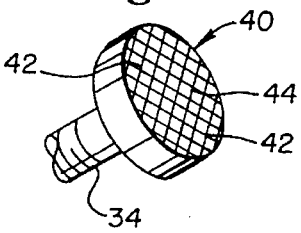
FIG. 9 is an enlarged fragmentary perspective view of another alternative embodiment of the present invention; and, FIG. 10 is a fragmentary enlarged side elevational view with parts cutaway of another alternative embodiment of the present invention.

It is recognized that fuel atomizer 12 may take on many different shapes and sizes and still fall within the scope of the present invention. Atomizing head 30 may be smooth, textured, or take on various other non-planar shapes and surfaces. For example, FIGS. 4–9 show alternative embodiments for the atomizing head 30 of the present invention. FIG. 4 shows a disk 40 with a groove 42, surface 44, and flange 48; FIG. 5 shows a disk 40 with a groove 42, and surface 44; FIG. 6 shows a disk 40 having a funneled surface 44; FIG. 7 shows a disk 40 having a surface 44; FIG. 8 shows a disk 40 having a surface 44 with a partial groove 42; and FIG. 9 shows disk 40 having shallow grooves 42, which form a diamond pattern.

Each of the above embodiments provide varied degrees of fuel atomization within carburetor chamber 17. In each of these embodiments, as fuel droplets hit the disk 40 surface, the fuel droplets spread out creating a violent reaction with intake air resulting in vastly improved fuel atomization at the disk 40 surface and edges.

In one embodiment, fuel atomizer 12 simply consists of a rod-shaped body 32 having a smooth atomizing head 30 for improving fuel atomization in the carburetor system. The atomizing head 30 is in light contact with fuel inlet nozzle 20. The atomizing head may be centered on fuel inlet nozzle 20, or alternatively, may be located off-center with respect to fuel inlet nozzle 20.

The fuel atomizer 12 shown in FIG. 9 is a preferred embodiment of the present invention. In this embodiment, disk 40 has grooves 42 which form a diamond shaped pattern. The grooves 42 are shallow indentations in surface 44. As fuel droplets hit surface 44, the diamond shaped pattern of grooves 42 greatly enhance the fuel atomization which occurs on the surface and around the edges of disk 40. Additionally, the diamond shaped pattern provides uniform atomization of fuel around the disk edges 40.

Figure 10:
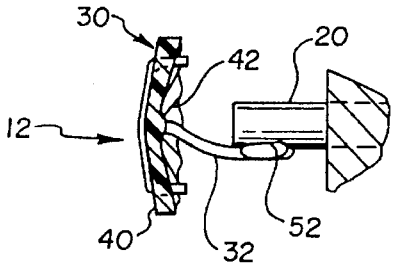

Yet another alternative embodiment of the present invention is shown in FIG. 10. In this embodiment, fuel atomizer 12 is supported by fuel inlet nozzle 20. As specifically shown, body 32 is secured to fuel inlet nozzle 20 at 52 by known means, such as welding or the use of adhesives.

In the above embodiment, body 32 is offset from atomizing head 30 for centering atomizing head 30 over fuel inlet nozzle 20. As fuel droplets hit the bottom surface of atomizing head 30, the fuel is uniformly distributed towards the edges of disk 40, resulting in atomization of fuel along the edges of disk 40. As shown, the atomizing head 30 may include grooves 42 for increased fuel atomization.

The above embodiment is also easily adaptable for use with carburetors in small engines. Additionally, the fuel atomizer may be used in new carburetor systems, or retrofitted for existing carburetors. By simply adapting the fuel atomizer to the carburetor system, fuel atomization is vastly increased, resulting in greater engine efficiency and cleaner exhaust emissions.

It is recognized that the fuel atomizer of the present invention is easily adaptable to many carburetor systems. For example, the fuel atomizer is adaptable to carburetor systems which have an angled fuel inlet nozzle entering the carburetor chamber. Additionally, the fuel atomizer may be formed of different materials which are adaptable for use within a carburetor system environment.

It will be understood that this disclosure is, in many respects, only illustrative. Changes may be made in details, particularly in matters of shape, size, material, and arrangement of parts, without exceeding the scope of the invention. Accordingly, the scope of the invention is as defined in the language of the appended claims.

What is claimed is:

1. An apparatus for atomizing fuel in a carburetor, the carburetor having a fuel inlet, the apparatus comprising:

a. means for atomizing fuel leaving the fuel inlet;

b. means for supporting the atomizing fuel means within the carburetor; and c. means for adjusting the atomizing fuel means relative to the fuel inlet, along a common longitudinal axis with respect to the fuel inlet.

2. The apparatus of claim 1, wherein the means for atomizing fuel includes a generally disc shaped member.

3. The apparatus of claim 2, wherein the generally disc shaped member includes a flange.

4. The apparatus of claim 1, wherein the adjusting means includes a handle for adjusting the means for atomizing fuel from a position exterior the carburetor.

5. The apparatus of claim 1, wherein the adjusting means extends through a carburetor wall.

6. The apparatus of claim 1, wherein the adjusting means is threaded.

7. An apparatus for atomizing fuel in a carburetor, the carburetor having a fuel inlet, the apparatus comprising:

a. a generally disk-shaped fuel atomizing member having a surface and an edge located along a common longitudinal axis with respect to the fuel inlet which is generally perpendicular to the surface; and b. means for supporting the generally disk-shaped member within the carburetor wherein the support means is adjustable, for adjusting the position of the atomizing surface relative to the fuel inlet.

8. The apparatus of claim 7, further including:

a. a flange extending outward from the generally disk-shaped member.

9. The apparatus of claim 7, wherein the atomizing surface of the disk-shaped member is textured.

10. The apparatus of claim 7, wherein the atomizing surface of the disk-shaped member includes at least one notch.

11. The apparatus of claim 7, wherein the atomizing surface of the disk-shaped member is generally cone-shaped.

12. An apparatus for atomizing fuel in a carburetor, the carburetor having a fuel inlet, the apparatus comprising:

a. a generally disk-shaped fuel atomizing member having a surface and an edge located along a common longitudinal axis with respect to the fuel inlet which is generally perpendicular to the surface; and b. means for supporting the generally disk-shaped member within the carburetor wherein the atomizing surface of the disk-shaped member is etched to include shallow grooves forming a diamond pattern.

13. An apparatus for atomizing fuel in a small engine carburetor having a fuel inlet, the apparatus comprising:

a. means for atomizing fuel having a surface located along a common longitudinal axis with respect to the fuel inlet which is substantially perpendicular to the surface; and b. means for supporting the atomizing fuel means within the carburetor, including means for adjusting the means for atomizing fuel relative to the fuel inlet.

14. The apparatus of claim 13, wherein the means for adjusting the atomizing fuel means relative to the fuel inlet adjusts the atomizing fuel means along a common longitudinal axis with respect to the fuel inlet.

15. The apparatus of claim 13, wherein the support means extends from a carburetor sidewall.

16. The apparatus of claim 13, wherein the atomizing fuel means is generally disk-shaped having an atomizing surface.

* * * * *